US008333682B2

(12) United States Patent
Sporn

(10) Patent No.: US 8,333,682 B2
(45) Date of Patent: Dec. 18, 2012

(54) SWIM TRAINING HARNESS

(76) Inventor: Joseph S. Sporn, New York, NY (US)

( * ) Notice: Subject to any disclaimer, the term of this patent is extended or adjusted under 35 U.S.C. 154(b) by 462 days.

(21) Appl. No.: 12/768,187

(22) Filed: Apr. 27, 2010

(65) Prior Publication Data

US 2011/0263387 A1 Oct. 27, 2011

(51) Int. Cl.
*A47D 13/04* (2006.01)
*A62B 35/00* (2006.01)

(52) U.S. Cl. ..... 482/55; 482/69; 482/137

(58) Field of Classification Search ..... 482/55–56, 482/69, 137
See application file for complete search history.

(56) References Cited

U.S. PATENT DOCUMENTS

| | | | | |
|---|---|---|---|---|
| 1,711,864 | A * | 5/1929 | Whidden | 119/770 |
| 2,434,542 | A * | 1/1948 | Borroughs | 482/56 |
| 3,424,134 | A * | 1/1969 | Rosenblum | 182/3 |
| 4,095,657 | A * | 6/1978 | Hohwart | 482/55 |
| 4,922,860 | A * | 5/1990 | Hutchings | 482/69 |
| 5,498,219 | A * | 3/1996 | Soufi | 482/69 |
| 6,338,699 | B1 * | 1/2002 | Veitch | 482/69 |
| 6,361,478 | B1 * | 3/2002 | Giancaspro | 482/69 |
| 6,910,993 | B1 * | 6/2005 | Baran | 482/69 |
| 7,104,932 | B1 * | 9/2006 | Brentlinger | 482/57 |
| 7,341,025 | B1 * | 3/2008 | Streeter et al. | 119/857 |
| 7,494,450 | B2 * | 2/2009 | Solomon | 482/69 |
| 7,673,945 | B1 * | 3/2010 | Riffel et al. | 297/485 |
| 7,780,587 | B2 * | 8/2010 | Thornton et al. | 482/143 |
| 8,147,252 | B1 * | 4/2012 | Stanford et al. | 434/255 |
| 8,235,173 | B2 * | 8/2012 | Kopp | 182/6 |
| 2003/0162636 | A1 * | 8/2003 | West | 482/69 |
| 2007/0037670 | A1 * | 2/2007 | Blaski et al. | 482/55 |
| 2007/0142185 | A1 * | 6/2007 | Woodman et al. | 482/69 |

* cited by examiner

*Primary Examiner* — Stephen Crow
(74) *Attorney, Agent, or Firm* — Richard W. Hanes; Hanes & Bartels

(57) ABSTRACT

Swim training apparatus comprising, a pair of leg bands, each having posterior sides and adapted to be secured around the thigh portion of a swimmer's legs, a waist band having a posterior side and adapted to be secured around the waist of a swimmer, a lever arm attached to waist band and having distal ends and a center and a pair of connecting straps each having distal and proximate ends where the proximate ends are attached to the respective distal ends of the lever arm and the distal ends of the straps are attached to the respective posterior sides of the leg bands.

6 Claims, 4 Drawing Sheets

SWIM TRAINING HARNESS

FIELD OF THE INVENTION

The present invention relates to apparatus to be applied to the body of a novice swim student to enhance confidence and provide a teaching aid for the instructor.

BACKGROUND

Most beginning swim students, and especially young children, find that being placed in a prone swimming position in a body of water is an intimidating, if not a frightening experience, and not one adapted to inspire confidence. Even with the underbody hand support of an instructor many beginners are prone to panic when asked to reach and pull or do the crawl and scissor kick at the same time.

As the inspiration for the present invention, it has been discovered that beginners immediately relax and become receptive to teaching commands once the student senses lifting type of support at the small of the back.

The prior art has seen many different configurations of apparatus designed to either assist beginning swimmers or provide instruction to more advanced swimmers. The U.S. Patent to Lan et al., U.S. Pat. No. 7,185,598 for Swim Training and Buoyancy Assist Device, is one illustration of the prior art where the distal end of a tether is attached to a belt around the swimmer's waist. The tether is anchored to the side of a swimming pool restraining the swimmer from moving more than a short distance in one direction from the anchor. While possibly providing apparent buoyancy or lifting, the device would not prevent a beginning swimmer from sinking to a depth that would produce panic.

Similar apparatus have been developed by others but suffer from the same disadvantage, that is, the device is primarily useful to a swimmer who has at least some ability to cope with the water and execute at least remedial swimming strokes without fear.

Accordingly, it is the primary object of the present invention to provide an easily donned and non-hampering harness to be worn by a beginning swim student that will provide a swim instructor with means to build confidence and reduce the student's fear of the water.

Another object of the invention is to provide a harness for the beginning swimmer that includes a handle by which an instructor can easily provide a lifting force to the lower back of a prone swim student to keep the student from being immersed in the water to an extent that will cause panic and fear.

Another and further object of the invention is to combine the function of supporting the swimmer by lifting the handle on the swimmer's harness with the added function of moving the swimmer's legs in a manner that will encourage the leg kicking that is required of a prone swimmer.

Other and further objects, features and advantages of the present invention will become apparent on a reading of the following description of the preferred form of the invention taken in conjunction with the attached drawings.

SUMMARY OF THE INVENTION

The swim training harness of the present invention includes a waist belt with an operating handle, two leg bands and a pair of straps interconnecting the operating handle and the respective leg bands. The operating handle serves two purposes. It acts first as the point of application of the lifting force. Second, when rotated to a limited degree, the operating handle mechanism will put tension on one of the connecting straps, causing the leg to which the respective leg band is attached to be raised, simulating the intentional movement of the leg in the required kicking motion. Limited rotation of the handle in the opposite direction will cause the other leg to be raised.

DETAILED DESCRIPTION

Figure 1:
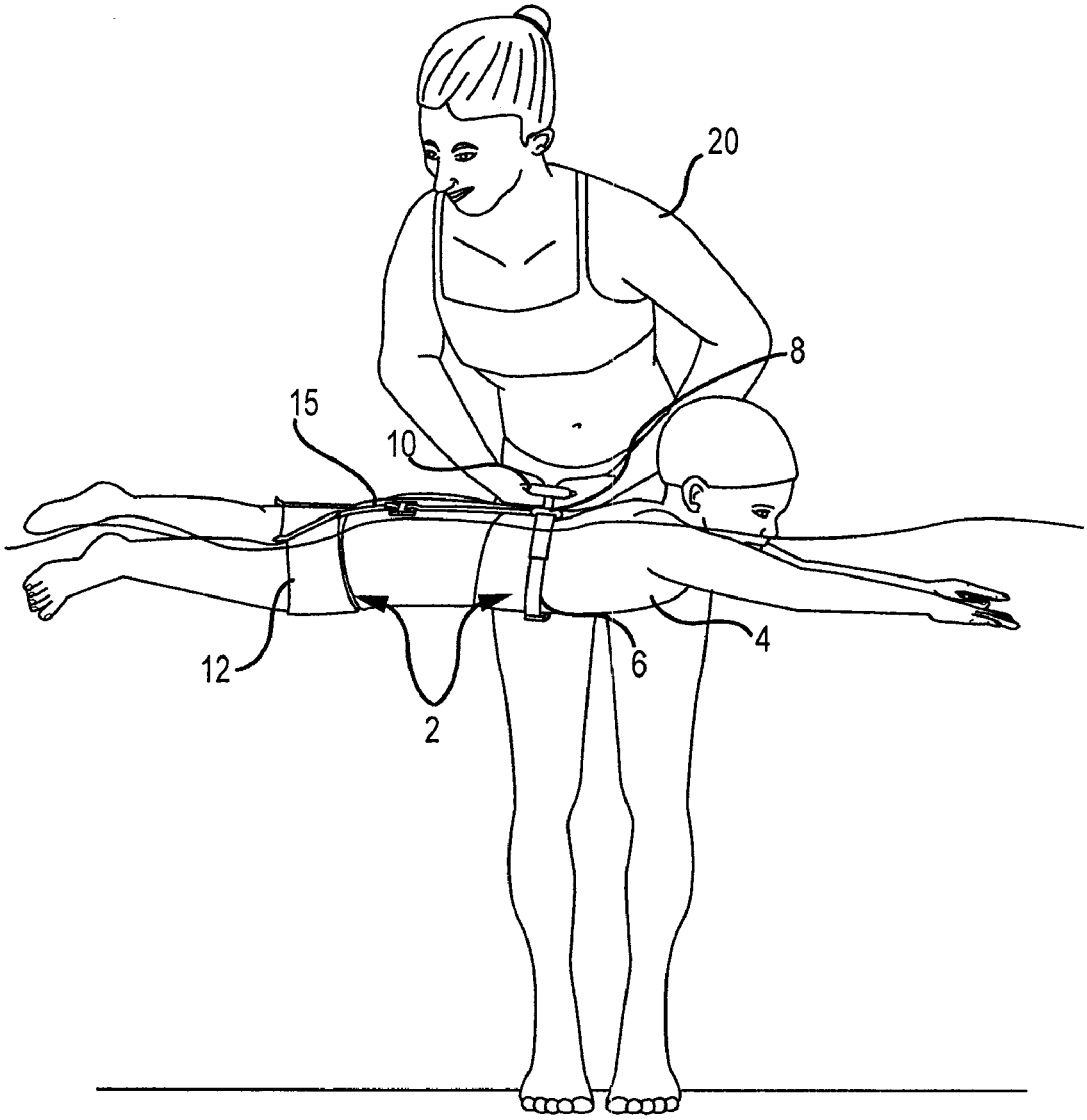
FIG. 1 is a perspective view of a beginning swimmer being supported in the water by an instructor whose hand is grasping the handle of the harness of the present invention which is being worn by the swimming student.
Figure 2:
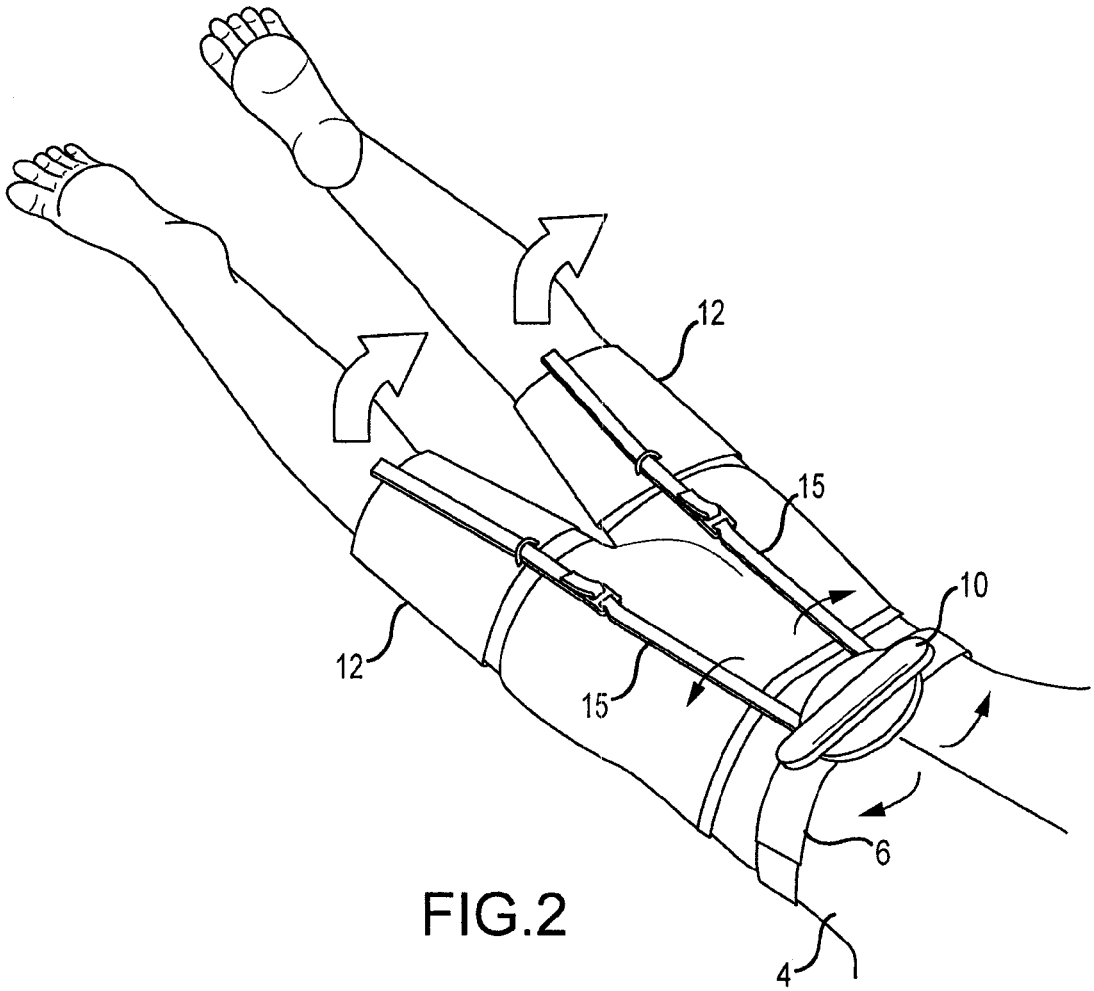
FIG. 2 is a posterior view of a swim student wearing the assist harness of the present invention.

Referring first to FIG. 1, the harness 2 of the present invention is worn by a beginning swim student 4. The primary components of the harness comprise a belt 6 adapted to be secured around the waist of the student, a lever arm assembly 8 carried by the belt 6 at a position above the lumbar spine of the student, a handle 10 operably connected to the lever assembly, a pair of leg bands 12 that encircle the student's thighs and straps 15 that interconnect the leg bands and the lever assembly 8.

Figure 3:
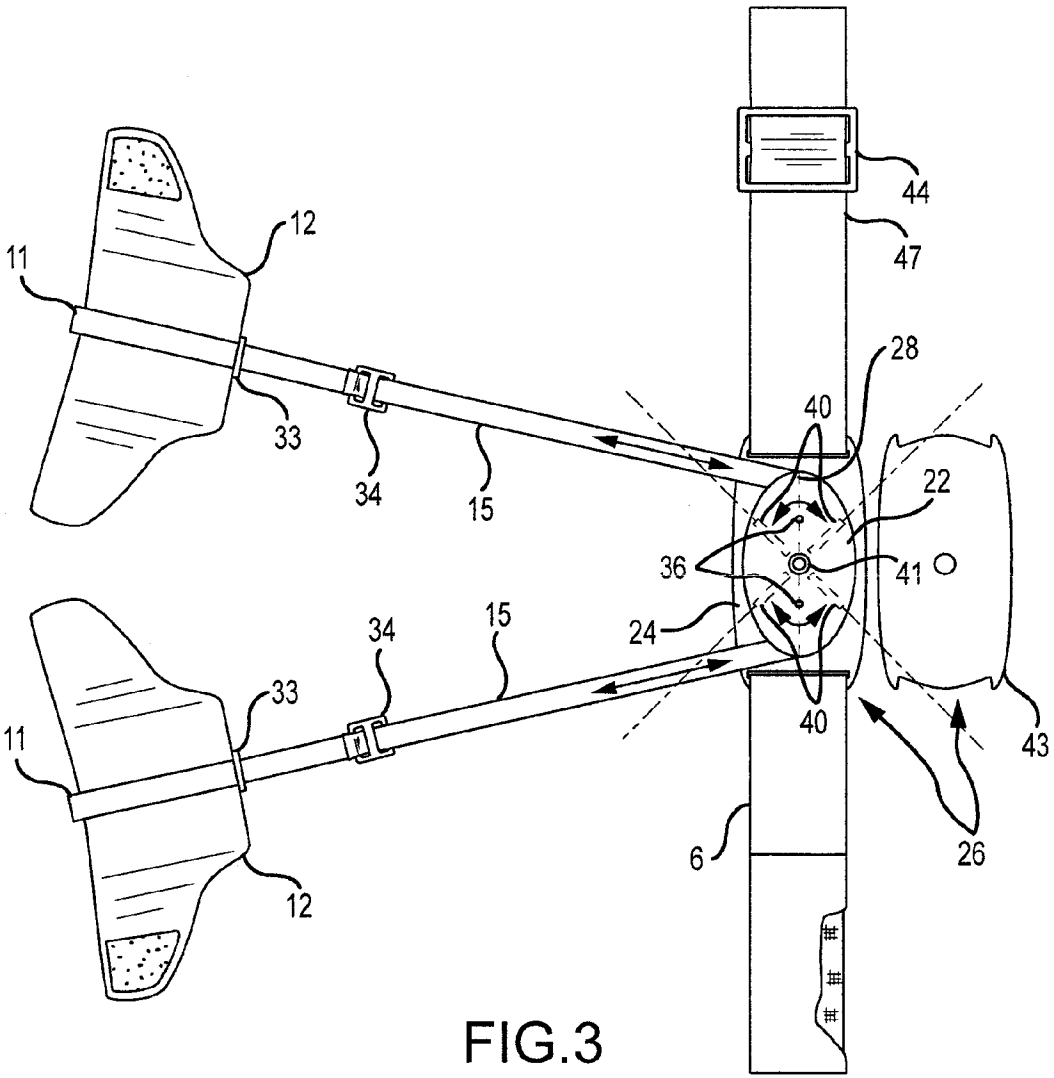
FIG. 3 is a top view of the harness of the present invention with the handle removed for clarity of illustrating the lever arm structure.
Figure 4:
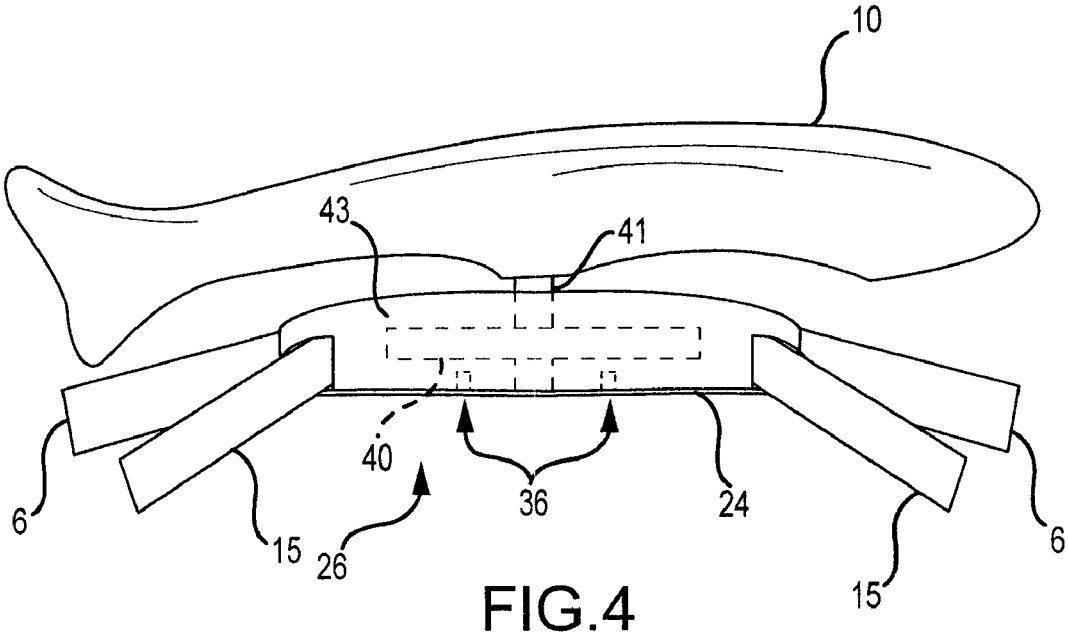
FIG. 4 is a side view of the lever arm assembly housing, showing the attachment of the operating handle to the lever arm.
Figure 5:
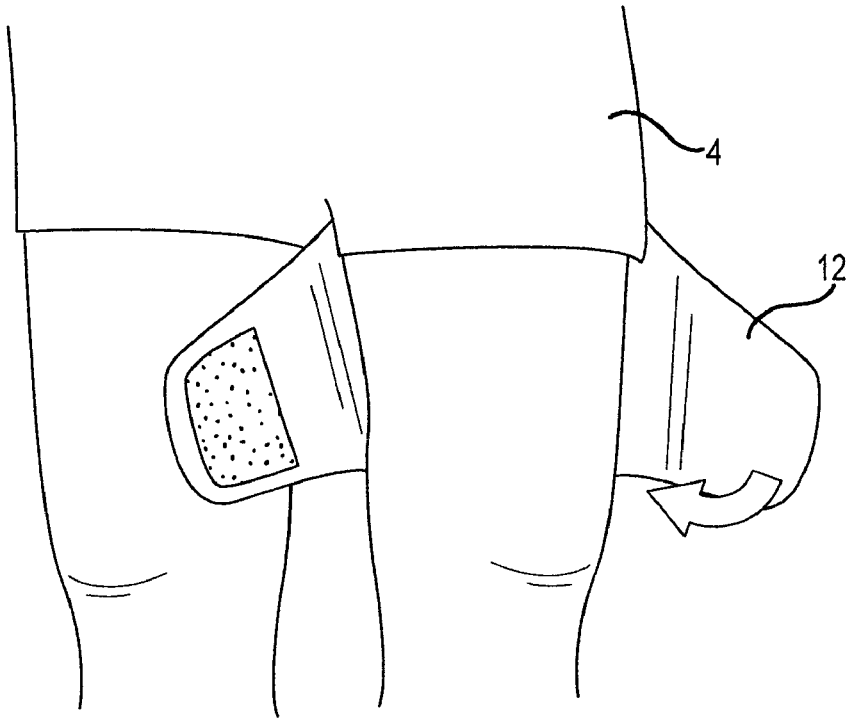
FIG. 5 is an anterior view of the harness leg bands before being closed around and attached to the legs of the swim student.

As seen in FIG. 1, the handle 10 is grasped by a swim instructor 20 to provide a lifting force at the waist that will be sufficient to put the student at ease without feeling that he is going to sink. The lever arm assembly 8 is shown in FIG. 3 as being attached to the belt 6 in a position that when worn by the student the lever assembly will be over the student's lumbar spine. The lever arm assembly comprises an elliptically shaped disk 22 that is rotatably mounted at its center on the base portion 24 of the lever arm assembly housing 26. The long axis 28 of the elliptical disk 22 acts as a lever arm, the distal ends of which are attached to the respective proximal ends of the two connecting straps 15, While the lever arm 28 of the preferred embodiment takes the shape of an elliptical disk 22, the lever arm can be a more simplistic shape, such as, for example, a simple elongated arm pivoted at it center with the connecting straps connected to the distal ends of the arm.

The leg bands 12 are constructed of flexible material that accommodates being wrapped around the thigh portion of a human leg. Hook and loop attachment material secures each leg band around the leg. The posterior side of each leg band is provided at its lower edge with a ring 31 to which the respective distal ends of the straps 15 are secured. In vertical alignment with the ring 31, the upper edge of the posterior side of each leg band is provided with a second ring 33 through which the respective connecting strap is trained for sliding movement. Each of the connecting straps 15 is provided with a length adjusting buckle 34 intermediate the strap's proximal and distal ends.

Looking further at the lever arm assembly, it is seen in FIG. 3 that the underside of elliptical disc 22 is provided with two pair of angularly fences 40 the respective members of which are angularly related to one another by 90°. The apex of the fence angle is located at the center of rotation of the disc 22. Attached to the base 24 of the housing 26 are two spaced apart upwardly projecting pins 36 that are located below the long axis of the disc 22 when the disc is in a neutral position, as shown in FIG. 3.

The handle 10 is secured to a shaft 41 that is perpendicular to the plane of the disc 22. The shaft projects from the surface of the disc a sufficient distance to engage a bore in the bottom of the handle 10 and hold the handle at a sufficient distance from the top cover 43 of the housing 28 that will permit the handle to be fully grasped by the hand and fingers of an instructor.

The belt 6 of the harness 2 may be constructed of a suitable webbing material with length adjusting buckles 44. The webbing may be covered in whole or in part by a rubber sleeve 47 to prohibit undesired bending or twisting of the webbing and to enhance the comfort of the harness.

In operation, once the instructor has stabilized the student by holding vertical pressure on the handle 10 the instructor can then proceed to introduce the kicking maneuvers that are critical to swimming technique. By rotating the handle 45° the attached lever arm 28 (the disc 22 in the preferred embodiment) will rotate causing the connecting straps 15 to respectively pull on one of the leg bands, raising the leg to which that band is attached, and relaxing tension on the other connecting strap, allowing the leg to which that strap is connected to lower deeper into the water. By reversing the direction of rotation of the handle by 90° the opposite effect is achieved. As the student gets the feeling of how the legs should flutter to perform the proper kicking action, the instructor may increase the frequency of rotation and reverse rotation to enhance the kicking maneuver all the while keeping upward lifting pressure on the handle to steady the student and improve his confidence in dealing with breathing and otherwise dealing with a water environment. The handle 10 is restrained from rotation beyond 45° from its neutral position by the engagement of the disc fences 40 with the stop pins 36.

What is claimed is:

1. Swim training apparatus comprising, a pair of leg bands, each having posterior sides and adapted to be secured around the thigh portion of a swimmer's legs, a waist band having a posterior side and adapted to be secured around the waist of a swimmer, a lever arm having distal ends and a center, means rotatably attaching the center of the lever arm to the posterior side of the waist band, a pair of connecting straps each having distal and proximate ends where the proximate ends are attached to the respective distal ends of the lever arm and the distal ends of the straps are attached to the respective posterior sides of the leg bands.

2. The swim training apparatus of claim 1 and further comprising, an elongated handle having a bottom and a point on the bottom at which the handle is attached to the lever arm for rotating the lever arm.

3. The swim training apparatus of claim 2 where the bottom of the handle on either side of the attachment point is spaced from the waist bend a sufficient distance that the handle can be grasped by a human hand.

4. The swim training apparatus of claim 3 where each of the connecting straps include length adjusting buckles.

5. The swim training apparatus of claim 4 and further including, stop means attached to the waist band for limiting the rotation of the lever arm.

6. The swim training device of claim 5 where the lever arm is an elliptically shaped disc.

* * * * *